US009321564B2

(12) United States Patent
Claypool et al.

(10) Patent No.: US 9,321,564 B2
(45) Date of Patent: Apr. 26, 2016

(54) MECHANICALLY SECURED LID AND CONTAINER

(75) Inventors: Christopher Claypool, Huntersville, NC (US); Matthew Nettenstrom, Streamwood, IL (US); Michael A. Zarkis, Huntersville, NC (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 55 days.

(21) Appl. No.: 13/410,479

(22) Filed: Mar. 2, 2012

(65) Prior Publication Data

US 2012/0223077 A1 Sep. 6, 2012

Related U.S. Application Data

(60) Provisional application No. 61/448,468, filed on Mar. 2, 2011, provisional application No. 61/522,467, filed on Aug. 11, 2011.

(51) Int. Cl.
*B65D 55/02* (2006.01)
*B65D 43/02* (2006.01)

(52) U.S. Cl.
CPC ..... *B65D 43/0222* (2013.01); *B65D 55/02* (2013.01); *B65D 2203/00* (2013.01); *B65D 2543/00092* (2013.01); *B65D 2543/00296* (2013.01); *B65D 2543/00527* (2013.01); *B65D 2543/00537* (2013.01); *B65D 2543/00972* (2013.01)

(58) Field of Classification Search
CPC ..... B65D 2543/00092; B65D 2543/00296; B65D 2543/00509; B65D 2543/00972; B65D 50/04; B65D 50/046; B65D 50/048; B65D 50/06; B65D 50/062
USPC ..... 215/211, 213–219, 230, 274; 220/254.7–254.8, 255, 256.1, 274, 220/315, 318–319, 321, 324, 326, 378, 780, 220/784, 795, 802
See application file for complete search history.

(56) References Cited

U.S. PATENT DOCUMENTS

| | | | | | |
|---|---|---|---|---|---|
| 1,640,934 | A | * | 8/1927 | Grunwald | 220/301 |
| 2,576,580 | A | * | 11/1951 | Edwards | 215/272 |
| 3,405,828 | A | * | 10/1968 | St Pierre | 215/206 |
| 3,669,296 | A | * | 6/1972 | Drew et al. | 215/206 |

(Continued)

OTHER PUBLICATIONS

OXO, Tools you hold on to—Pantry & Countertop, accessed Jul. 26, 2012, http://www.oxo.com/c-119-pantry-countertop.aspx.

(Continued)

*Primary Examiner* — Bryon Gehman
*Assistant Examiner* — Brijesh V. Patel
(74) *Attorney, Agent, or Firm* — Marshall, Gerstein & Borun LLP

(57) ABSTRACT

A storage container has a base having an opening and a lid for covering the opening. A lock ring is mounted on one of the base and the lid for motion between a first position and a second position. At least one lock member is formed on the lock ring. At least one stationary lock member is formed on the other one of the base and the lid. The lock member is aligned with the stationary lock member when the lock ring is in the first position such that the lock member engages the stationary lock member. The lock member is offset with respect to the stationary lock member when the lock ring is in the second position such that the lock member does not engage the stationary lock member.

18 Claims, 9 Drawing Sheets

(56) References Cited

U.S. PATENT DOCUMENTS

| | | | | | |
|---|---|---|---|---|---|
| 3,843,007 | A * | 10/1974 | Meyer | 215/206 |
| 3,851,788 | A * | 12/1974 | Hammes | 220/319 |
| 3,901,400 | A * | 8/1975 | Westfall | 215/221 |
| 3,913,769 | A * | 10/1975 | Scrocco et al. | 215/206 |
| 4,006,836 | A * | 2/1977 | Micallef | 215/218 |
| 4,312,459 | A * | 1/1982 | Leach | 220/256.1 |
| 4,335,827 | A * | 6/1982 | Knize et al. | 220/284 |
| 4,399,921 | A * | 8/1983 | Kusz | B65D 50/04 215/214 |
| 4,512,485 | A * | 4/1985 | Agbay et al. | 215/225 |
| 4,625,890 | A * | 12/1986 | Galer | 220/319 |
| 4,718,571 | A * | 1/1988 | Bordner | 220/270 |
| 5,058,754 | A * | 10/1991 | Hickerson | 215/201 |
| 5,129,537 | A * | 7/1992 | Bordner et al. | 220/321 |
| 5,197,617 | A * | 3/1993 | Edwards | 215/221 |
| 5,224,615 | A * | 7/1993 | Hickerson | 215/218 |
| 5,316,162 | A * | 5/1994 | Pierson | 215/223 |
| 5,397,008 | A * | 3/1995 | Glynn | 215/225 |
| 5,462,181 | A * | 10/1995 | Glynn | 215/204 |
| 5,605,244 | A * | 2/1997 | Bradshaw | 220/320 |
| 5,667,092 | A * | 9/1997 | Julius et al. | 220/259.1 |
| 5,706,962 | A * | 1/1998 | Tauber | 215/218 |
| 5,727,704 | A * | 3/1998 | Glynn | 215/223 |
| 5,735,417 | A * | 4/1998 | Darr et al. | 215/216 |
| 5,785,201 | A * | 7/1998 | Bordner et al. | 220/321 |
| 5,788,098 | A * | 8/1998 | Mader | 215/219 |
| 5,819,967 | A * | 10/1998 | Lo | 215/206 |
| 5,927,529 | A * | 7/1999 | Hofmann et al. | 215/223 |
| 6,016,930 | A * | 1/2000 | Mathes et al. | 215/216 |
| 6,170,691 | B1 * | 1/2001 | Morris et al. | 220/304 |
| 6,402,798 | B1 * | 6/2002 | Kallsen et al. | 55/385.3 |
| 6,851,569 | B2 * | 2/2005 | Conti et al. | 220/297 |
| 2005/0006390 | A1 * | 1/2005 | Wang | 220/326 |
| 2005/0236413 | A1 * | 10/2005 | Maciag et al. | 220/256.1 |
| 2006/0138072 | A1 * | 6/2006 | Mishra | 215/274 |
| 2006/0201946 | A1 * | 9/2006 | Witt | 220/276 |
| 2006/0261066 | A1 * | 11/2006 | Boozer et al. | 220/254.7 |
| 2007/0045330 | A1 * | 3/2007 | McFadyen | 220/793 |
| 2007/0102438 | A1 * | 5/2007 | Schwarz | 220/782 |
| 2007/0205196 | A1 * | 9/2007 | Burney et al. | 220/276 |
| 2007/0205206 | A1 * | 9/2007 | Church | 220/791 |
| 2008/0011879 | A1 * | 1/2008 | Gerson et al. | 239/337 |
| 2008/0105681 | A1 * | 5/2008 | Vovan | 220/288 |
| 2009/0152271 | A1 * | 6/2009 | Kuzelka | 220/319 |
| 2009/0289066 | A1 | 11/2009 | DiPietro et al. | |
| 2009/0289074 | A1 | 11/2009 | McNamara | |
| 2011/0084074 | A1 * | 4/2011 | Reed | 220/298 |
| 2011/0108553 | A1 * | 5/2011 | Pantelleria | 220/319 |
| 2011/0226768 | A1 * | 9/2011 | Sexton et al. | 220/252 |
| 2012/0037654 | A1 | 2/2012 | McNamara | |
| 2012/0138562 | A1 * | 6/2012 | Letica et al. | 215/221 |

OTHER PUBLICATIONS

OXO, Tools you hold on to—Refrigerator & Freezer, accessed Jul. 26, 2012, http://www.oxo.com/c-120-refrigerator-freezer.aspx.

* cited by examiner

MECHANICALLY SECURED LID AND CONTAINER

CROSS-REFERENCE TO RELATED APPLICATIONS

This application claims benefit of priority under 35 U.S.C. §119(e) to the filing date of U.S. Provisional Patent Application No. 61/448,468, as filed on Mar. 2, 2011 and U.S. Provisional Patent Application No. 61/522,467, as filed on Aug. 11, 2011 which are incorporated herein by reference in their entirety.

BACKGROUND

The invention relates to storage containers. Storage containers typically comprise a base that forms a container for storing articles where the base is closed by a lid. The lid closes the base to secure the articles in the container. One such use of storage containers is for food storage where it is desirable that the closure between the base and lid seals the contents of the container.

SUMMARY OF THE INVENTION

A storage container comprises a base having an opening and a lid for covering the opening. A lock ring is mounted on one of the base and the lid for motion between a first position and a second position. At least one lock member is formed on the lock ring. At least one stationary lock member is formed on the other one of the base and the lid. The lock member is aligned with the stationary lock member when the lock ring is in the first position such that the lock member engages the stationary lock member. The lock member is offset with respect to the stationary lock member when the lock ring is in the second position such that the lock member does not engage the stationary lock member.

The lock ring may be mounted on the base adjacent the opening. The opening may be defined by a rim and a protuberance may be formed on the base and spaced from rim where the lock ring is constrained between the protuberance and the rim. The lock ring may comprise a peripheral edge that comprises a plurality of lock members formed as a plurality of protrusions that alternate with a plurality of recessed areas. The stationary lock member may comprise a plurality of stationary lock members formed as a plurality of protrusions that are positioned to align with the plurality of recessed areas. A handle may be provided on the lock ring that extends from the lock ring. The opening may be defined by a rim where a seal on the lid engages the rim when the lid is positioned on the base. The lid may comprise a wall that extends over the lock ring when the lid is positioned on the base. A plurality of stationary lock members may be formed on the wall, the plurality of stationary lock members comprising a plurality of protrusions that extend from the wall. A first indicia may be formed on the lid to identify the first position and a second indicia may be formed on the lid to identify the second position. The at least one of the lock member and the stationary lock member may be formed with a camming surface that engages the other one of the lock member and the stationary lock member to exert a force on the lid that pulls the lid into tight engagement with the base. The lock ring may be mounted on the lid. The stationary lock member may comprise a flange that extends from the base. The stationary lock member may comprise an area of the flange that is located at at least a corner of the base. The lid may comprise a wall that extends over the flange and supports the lock ring such that the lock ring may rotate relative to the lid. The lock ring may comprise a peripheral edge that comprises a plurality of lock members formed as a plurality of protrusions that alternate with a plurality of recessed areas. A plurality of stationary lock members may be formed on the wall, the plurality of stationary lock members comprising a plurality of areas of the flange located at a plurality of corners of the base.

A method of securing a lid to a base comprises providing a base having an opening and a lid for covering the opening and a lock ring mounted on one of the base and the lid for rotational motion between a first position and a second position, at least one lock member formed on the lock ring, and at least one stationary lock member on the other one of the base and the lid; and rotating the lock ring to a first position where the at least one lock member engages the at least one stationary lock member; and rotating the lock ring to a second position where the at least one lock member is offset with respect to the at least one stationary lock member such that the at least one lock member does not engage the at least one stationary lock member.

The method may comprise a camming surface on one of the lock member and the stationary lock member such that rotating the lock ring pulls the lid into engagement with the base. Rotating the lock ring may compress a seal between the lid and the base.

DETAILED DESCRIPTION OF EMBODIMENTS OF THE INVENTION

Figure 1:
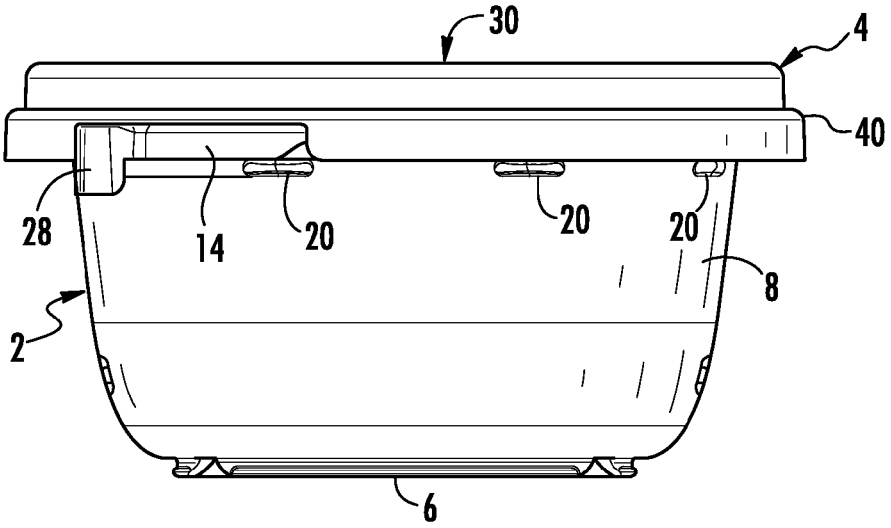
FIG. 1 is a plan view of an embodiment of the container of the invention in a locked position.
Figure 2:
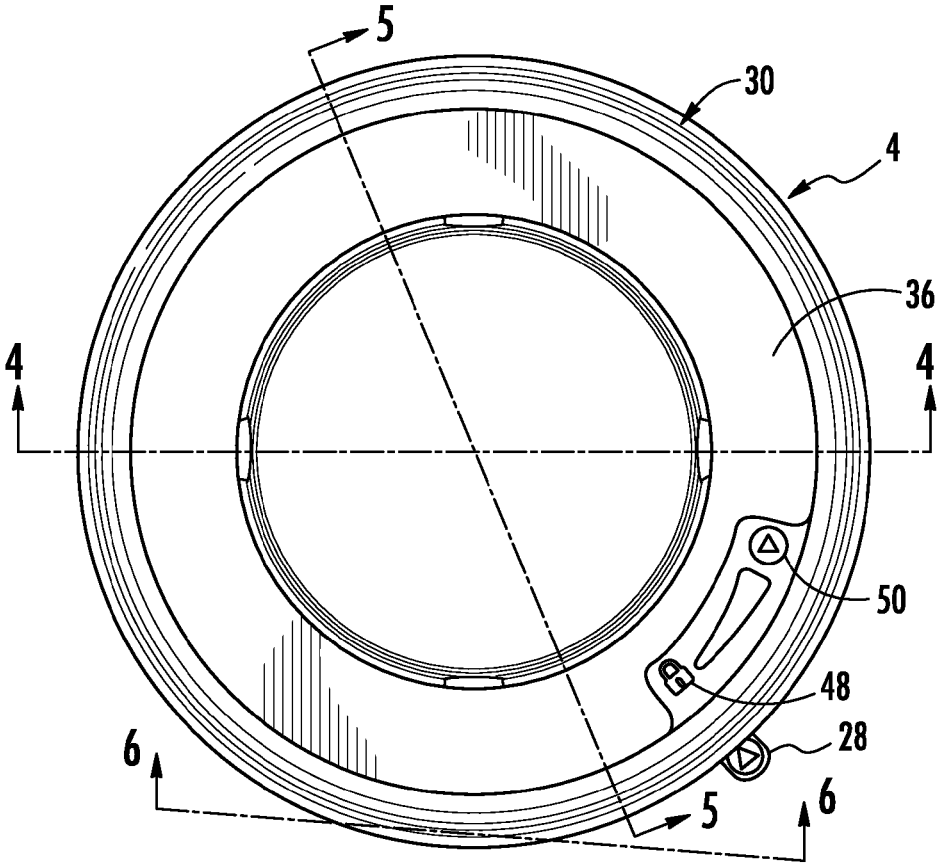
FIG. 2 is a top view of the container of FIG. 1.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above", or "upper" or "lower", or "horizontal" or "vertical", or "rear" or "front", or "upward" or "downward" may be used herein to describe a relationship of one element or component to another element or component as illustrated in the figures to facilitate explanation of the figures.

Referring to FIGS. 1 through 8, an embodiment of a storage container of the invention is shown comprising a base 2, a detachable lid assembly 4 and a lock ring 14. The base 2 comprises a bottom wall 6 that is connected to a side wall 8 to define an interior storage compartment 10. The bottom wall 6 may support the base 2 in an upright manner where the sidewall 8 extends vertically and defines an upwardly facing opening 16. The opening 16 is defined by a perimeter edge of the side wall 8 where the edge forms an outwardly projecting rim 12 that is engaged by the lid assembly 4 to close the container. The base 2 may be formed of plastic by molding or other similar process. Moreover, the base may be made of glass, metal or other material if desired. While an embodiment of the container is shown the container may have a wide variety of shapes and sizes and the opening 16 need not be upwardly opening.

The lock ring 14 is mounted on the base 2 adjacent the rim 12 such that the lock ring may rotate relative to the base. In one embodiment the lock ring 14 comprises a central opening 18 that receives the base 2 such that the lock ring is closely spaced from the side wall 8 of the base 2 and is positioned adjacent the rim 12. A restraining mechanism is used to mount the lock ring 14 on the base 2 such that the lock ring may rotate relative to the base. In one embodiment the restraining mechanism comprises series of protuberances 20 that are formed around the periphery of the side wall 8 and are spaced from rim 12 the approximate thickness of the lock ring 14. The lock ring 14 is mounted on the base 2 such that it is constrained between the protuberances and the rim 12. Where the base 2 and/or lock ring 14 are made of deformable material such as molded plastic, the base 2 may be inserted into the opening 18 of lock ring 14 and the lock ring may be forced over the protuberances such that the lock ring is constrained between the protuberances and the rim 12. The material of the base 2 and/or lock ring 14 may deform to allow the lock ring to pass over the protuberances during assembly of the container. The lock ring 14 may be mounted to the base 2 for rotational motion using other restraining mechanisms than the protuberances shown in the illustrated embodiment provided that the lock ring 14 is free to rotate relative to the base 2 but is otherwise mounted on the base. For example, the series of protuberances may be replaced by a single protuberance, or protuberances on the lock ring 14 may engage a mating slot formed on the base 2. Moreover, additional elements may be used as the restraining mechanism to mount the lock ring to the base; however, using a molded portion of the base to form the restraining element may be the most economical embodiment.

The lock ring 14 has an outer peripheral edge 22 that comprises a plurality of lock members 24. The lock members 24 comprise protrusions that extend outwardly and that alternate with a plurality of recessed areas 26 where the protrusions that form lock members 24 extend farther from the center of the lock ring 14 than the recessed areas 26 to form a plurality of lock members 24 spaced about the periphery of the lock ring 14. In the illustrated embodiment four protrusions are equally spaced about the periphery of the lock ring 14 and alternate with four recessed areas 26. A greater or fewer number of protrusions and recessed areas may be used and the protrusions and recessed areas may be arranged in patterns other than the symmetrical pattern shown in the figures. A handle 28 projects from the ring 14 such that it extends beyond the periphery of the ring.

Figure 17:
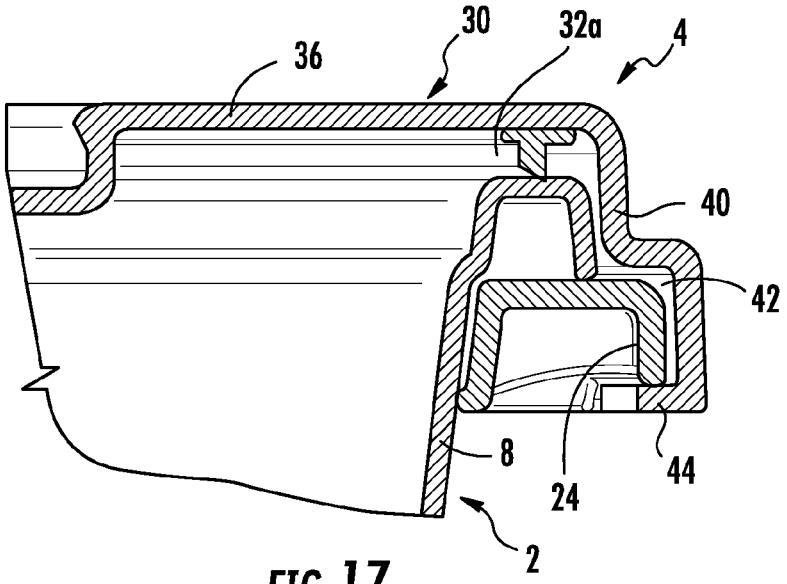
FIG. 17 is a partial section view similar to FIG. 4 of an alternate embodiment.

A lid assembly 4 may comprise a lid 30 and a separate seal or gasket 32. The lid 30 comprises a cover portion 36 that may define a generally planar member that is shaped and dimensioned to fit over and close the opening 16 defined by rim 12 of base 2 and an annular wall 40 that extends from cover portion 36. In one preferred embodiment both the rim 12 and the cover portion 36 are circular where the perimeter of cover portion 36 is disposed over the rim 12 when the lid assembly 4 is positioned on the base 2. The seal or gasket 32 may be secured to the underside of the cover portion 36. In one embodiment the seal or gasket comprises a separate component such as an O-ring that is attached to the lid 30 after manufacture as shown in FIGS. 4 through 8. In this embodiment the seal or gasket 32 may be fit into a receptacle 38 formed on the underside of the lid 30 such that the seal or gasket 32 is disposed over the rim 12 when the lid assembly 4 is positioned on the base 2. The seal or gasket 32 may be secured to the lid 30 by a friction fit, fasteners, adhesive, welding or the like. Alternatively, the lid 30 and the seal or gasket 32*a* may be formed as one-piece as shown in FIG. 17. For example, the seal or gasket 32*a* may be overmolded into the lid 30. Moreover, the lid 30 may not have a separately identifiable seal or gasket such that the rim 12 of base 2 makes contact with the lid 30.

A wall 40 extends from the cover portion 36 and is dimensioned to extend over the rim 12. Wall 40 extends over the side wall 8 of the base 2 a sufficient distance that the lock ring 14 is positioned inside of the rim 12, between the wall 40 and the side wall 8, when the lid assembly 4 is positioned on the base 2. The wall 40 defines a channel 42 that is dimensioned to receive the lock ring 14 such that the lock ring may rotate relative to the lid 30 when the lid assembly 4 is positioned on the base 2. A plurality of mating stationary lock members 44 are spaced about the interior of the wall 40 that selectively engage the lock members 24 on the lock ring 14 to lock the lid assembly 4 on the base 2. The stationary lock members 44 are formed as inwardly projecting protrusions that extend inwardly from wall 40 and that are spaced about the periphery of the wall 40 such that the protrusions that form stationary lock members 44 are positioned to align with the recesses 26 formed on the lock ring 14. Between the protrusions that form stationary lock members 44 are recessed areas 56 that do not project from wall 40 and that receive the lock members 24 when the lid 30 is positioned on the base 2. The stationary lock members 44 are referred to as "stationary" herein to distinguish these lock members from the lock members 24 on the lock ring and because during typical use of the container the lock ring is rotated relative to the stationary lock members 44; however, it is possible that the stationary lock members may also by rotated during use of the container such as by rotating the lid 30 relative to the lock ring 14 and base 2. In a preferred embodiment, the stationary lock members 44 formed on the lid are in a one-to-one relationship with the recesses 26 formed on the lock ring 14; however, the stationary lock members 44 and the recesses 26 do not have to be in a one to one relationship provided that each stationary lock member 44 aligns with a recess 26 when the lid 30 is positioned on the base 2. The wall 40 is formed with a cut-out area or gap 46 that receives the handle 28 on the lock ring 14. One end of the gap 46 is provided with a reference point such as visual indicator or indicia 48 indicating that the lid 30 is locked to the base 2 and the opposite end of the gap 46 is formed with a reference point such as a visual indicator or indicia 50 indicating that the lid 30 is unlocked from the base 2. While the illustrated embodiment uses a gap 46 in the wall 40 for receiving the handle, the handle 28 may be arranged such that it extends below the wall 40, or through a slot in the wall or the like. The indicia 48 and 50 are located on the lid 30 such that when the handle 28 of the lock ring 14 is positioned in an aligned position with the unlocked indicia 50, lock members 24 are offset from stationary lock members 44 such that the lid may be placed on and removed from the base 2 and when the handle 28 of the lock ring 14 is positioned in an aligned position with the locked indicia 48, the stationary lock members 44 on the lid 30 interfere with the lock members 24 on the lock ring 14 such that the lid 30 cannot be removed from the base 2, or placed on the base 2. While the handle 28 is used as the reference point on the lock ring 14 to align the lock ring 14 with the lid 30, the reference point on the lock ring 14 may be a structure other than the handle 28. For example, the lock ring 14 may be provided with a visual reference point such as a legend or indicia printed on the lock ring 14 or a separate reference point such as a physical arrow or pointer may be located on the lock ring 14 remote from the handle.

Figure 4:
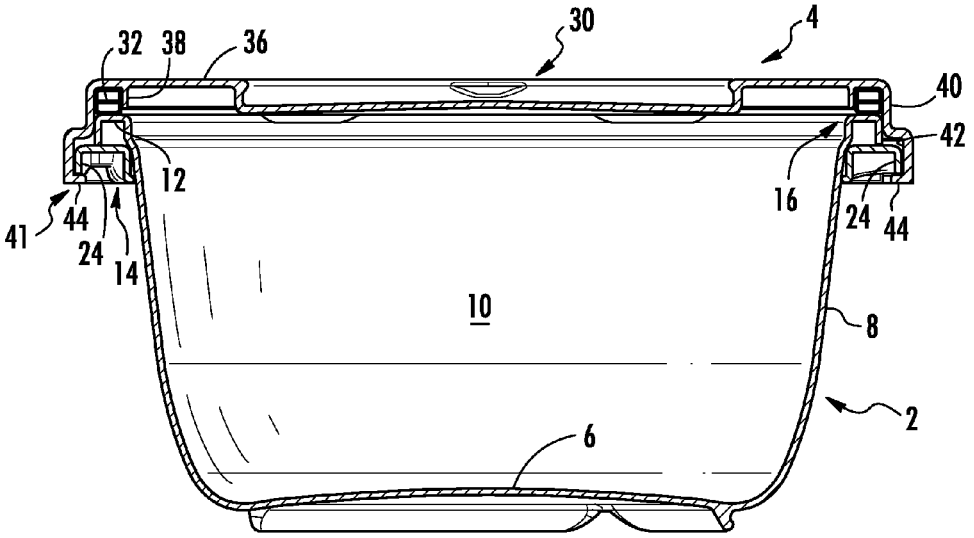
FIG. 4 is a section view taken along line 4-4 of FIG. 2.
Figure 5:
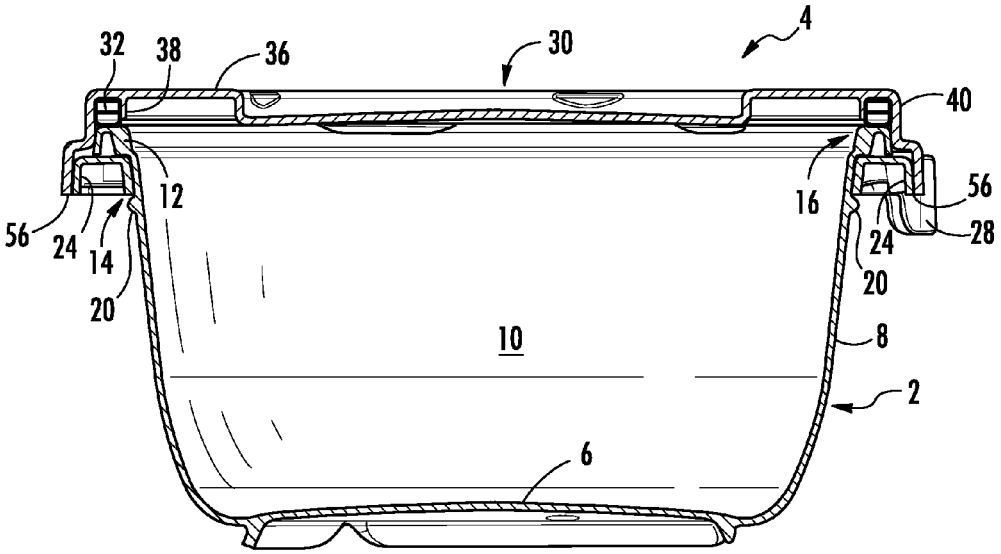
FIG. 5 is a section view taken along line 5-5 of FIG. 2.
Figure 8:
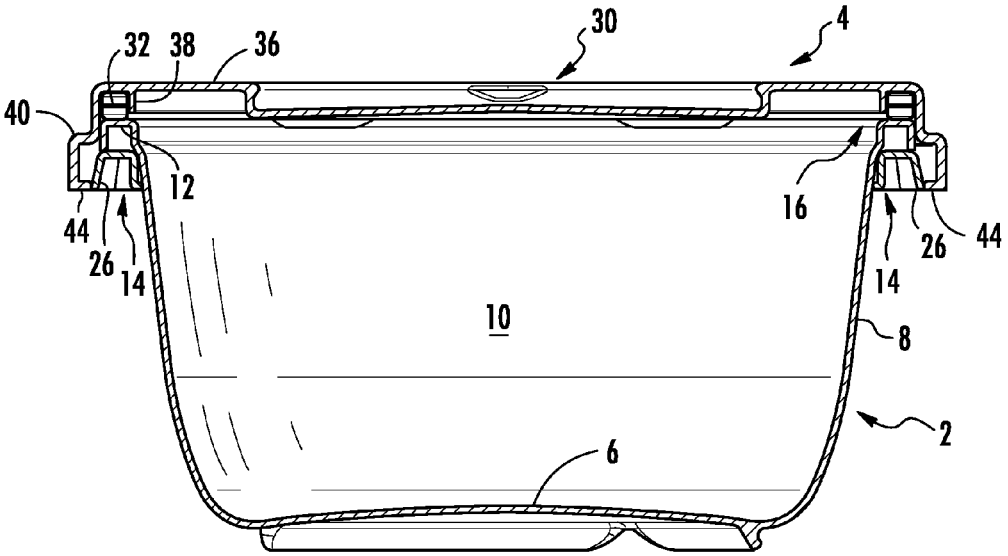
FIG. 8 is a section view taken along line 8-8 of FIG. 7.

To use the container of the invention, the lid assembly 4 is placed on the rim 12 of the base 2 such that the unlocked reference point 50 on the lid 30 is aligned with the reference point on the lock ring 14. In the illustrated embodiment the reference point on the lock ring 14 is the handle 28. In this position, illustrated in FIG. 8, the protrusions that form lock members 24 on the lock ring 14 are offset from the protrusions that form stationary lock members 44 on the wall 40 and are aligned with the recesses 56. Likewise, the recesses 26 on the lock ring 14 are aligned with the stationary lock members 44 on the lid 30. As a result, the lock members 24 do not interfere with or engage the stationary lock members 44 and the lid assembly 4 may be seated on the rim 12 of the base 2 with the seal or gasket 32 in sealing contact with the rim 12 as shown in FIG. 8. The lock ring 14 is then rotated relative to the lid 30 until the handle 28 is in the locked position aligned with the locked reference point 48. In this position the stationary lock members 44 on the lid 30 are aligned with and positioned under or behind the lock members 24 on the lock ring 14 such that the lock members 44 and 24 engage one another as shown in FIG. 4. In this position the lid assembly 4 may not be removed from the base 2 because the engagement of the stationary lock members 44 with the lock members 24 prevents the lid 30 from being pulled away from the base 2. To remove the lid the handle is rotated to the unlocked position to disengage the lock members 24 from the lock members 44.

Figure 6:
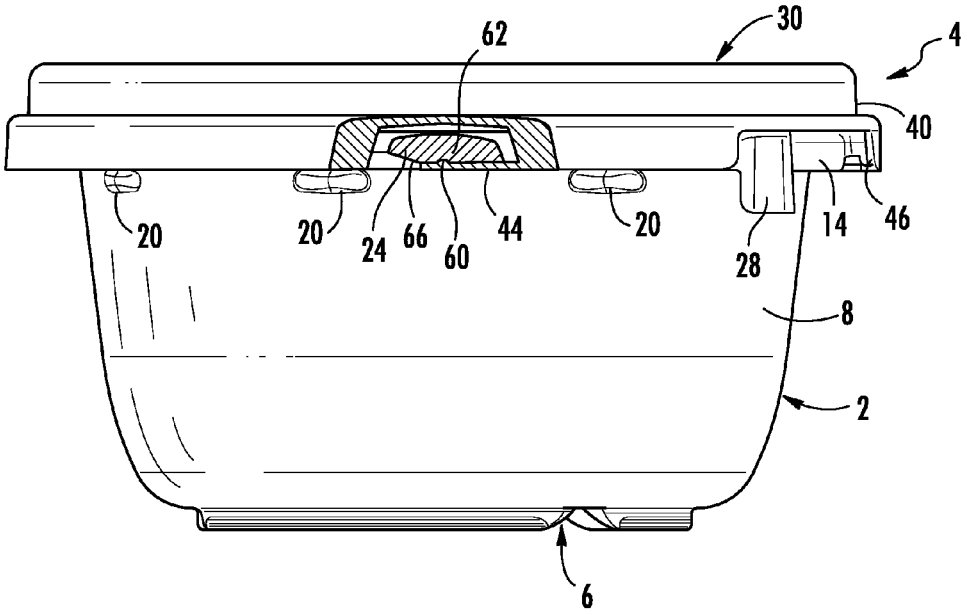
FIG. 6 is a section view taken along line 6-6 of FIG. 2.
Figure 7:
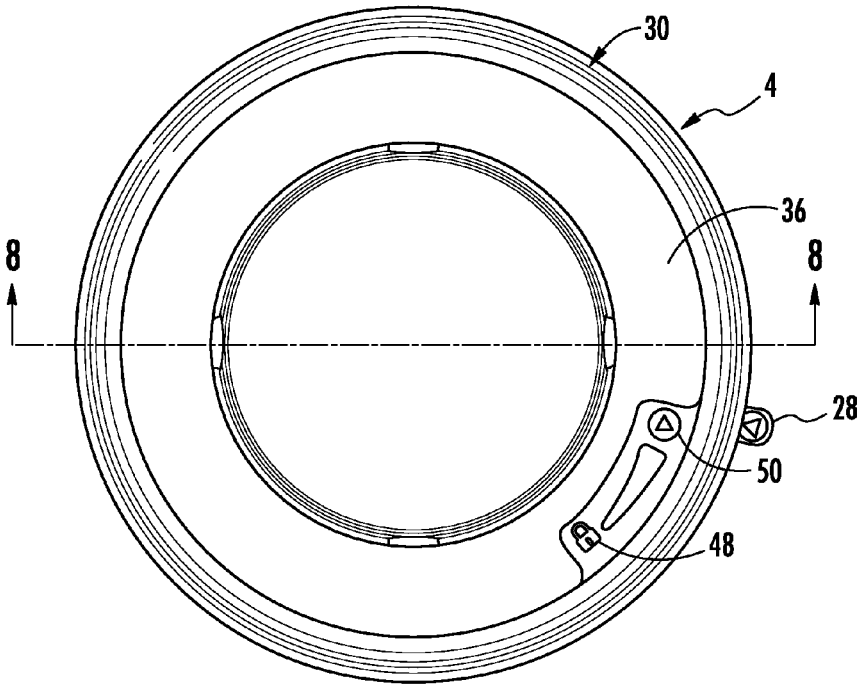
FIG. 7 is a top view of the container of FIG. 1 in an unlocked position.

Referring to FIG. 6, one of the lock ring 14 and the lid 30 may be provided with a protrusion or protrusions 60 that engage with a recess or recesses 62 formed on the other of the lock ring 14 and the lid 30 when the lock ring 14 is in the locked position to create a mechanical engagement between the lock ring 14 and the stationary lock ring 41. The protrusion 60 and the recess 62 may be configured to create feedback to the user that the lock is engaged. For example the engagement of the protrusion 60 and recess 62 may provide tactile feedback and/or may create an audible noise when protrusion 60 snaps into the recess 62.

Figure 3:
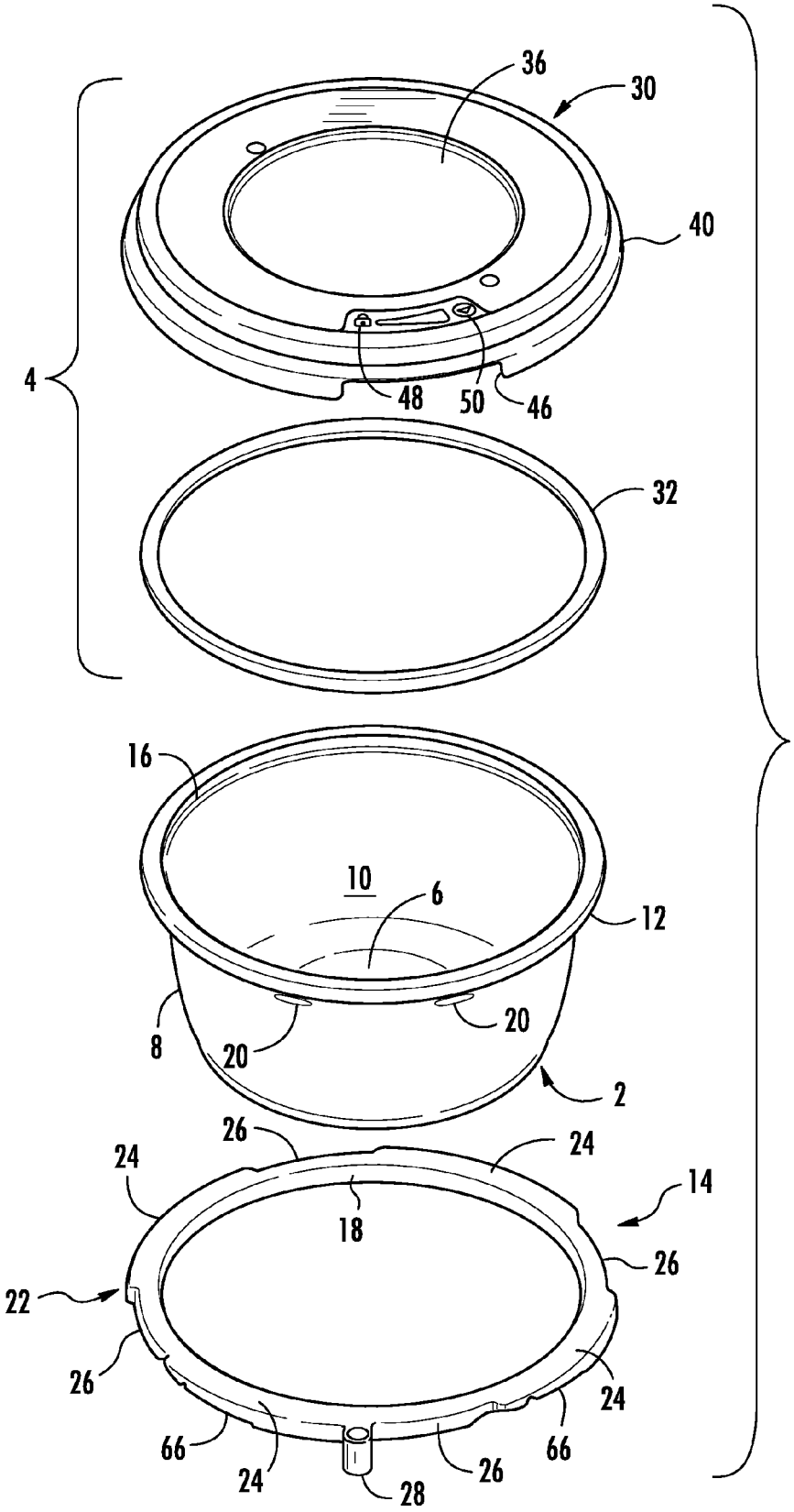
FIG. 3 is an exploded perspective view of the container of FIG. 1.

The engagement of the lock ring 14 with the stationary lock members 44 creates a tight seal between the lid assembly 4 and the base 2. In one embodiment the user may exert pressure on the lid to slightly compress and deform the gasket or seal 32 prior to locking the lock ring 14. The lock members 44 and 24 are dimensioned such that after the lock ring 14 is locked and the user releases the lid 30 the gasket or seal 32 remains compressed between the lid 30 and the base 2 to create a liquid and air tight seal. Referring to FIGS. 3 and 6, one or both of the mating lock members 24 and 44 may also be formed with angled camming surfaces 66 such that as the lock ring 14 is rotated the camming surfaces engage with the mating lock member to exert a force on the lid 30 that pulls the lid assembly 4 into tight engagement with the base 2 such that the gasket or seal 32 is compressed between the lid 30 and the rim 12 of the base 2.

Figure 9:
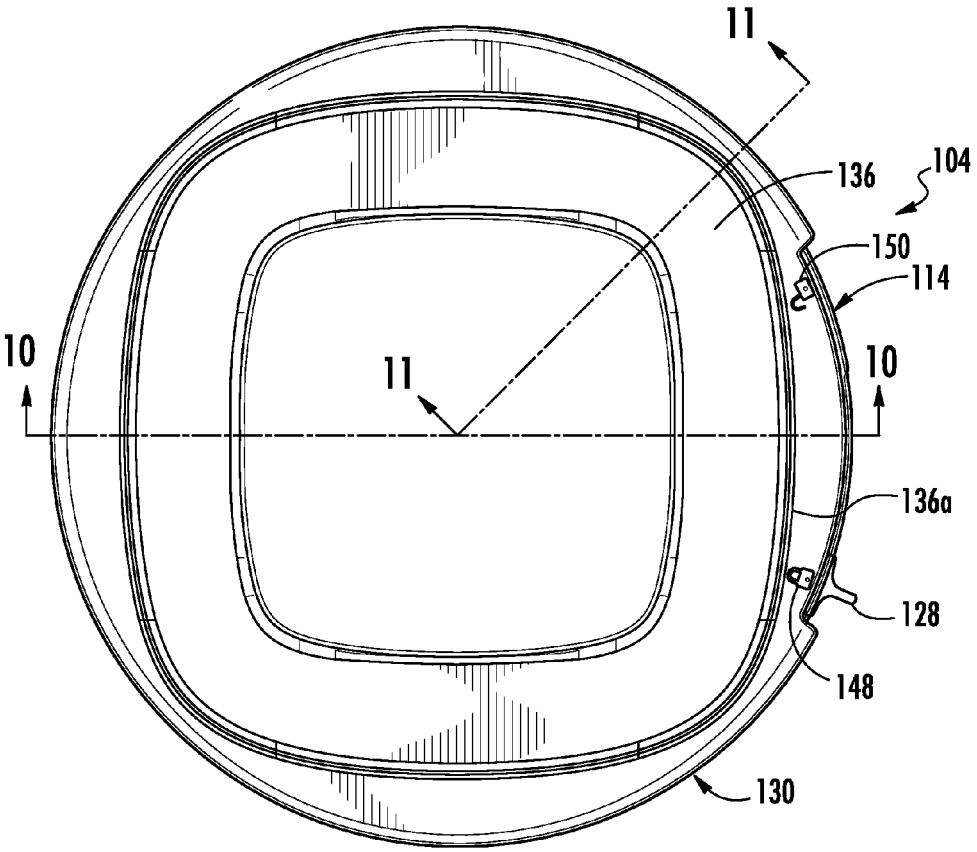
FIG. 9 is a top view of another embodiment of the container of the invention in a locked position.
Figure 10:
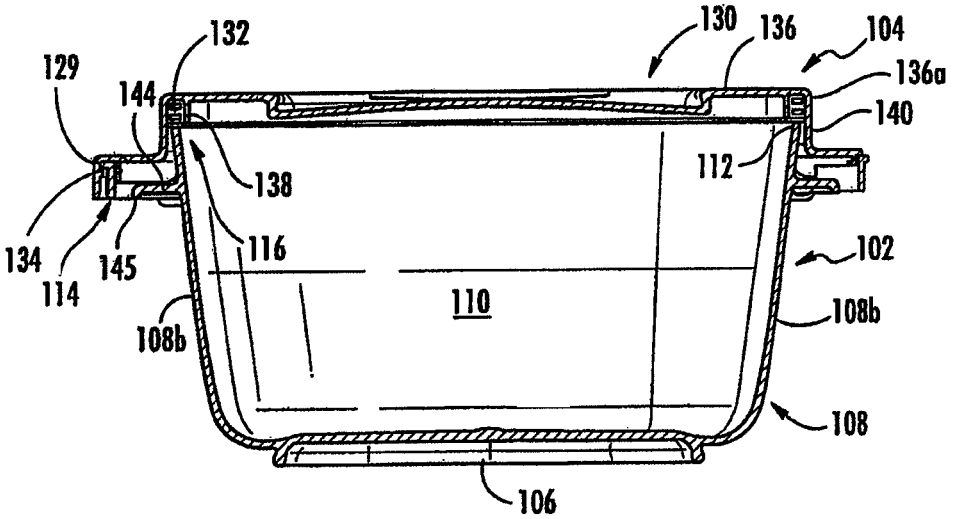
FIG. 10 is a section view taken along line 10-10 of FIG. 9.

An alternate embodiment of the container is shown in FIGS. 9 through 16 where the lock ring is mounted on the lid and the locking mechanism is used with a non-round base. The base 102 comprises a bottom wall 106 that is connected to a side wall 108 to define an interior storage compartment 110. The bottom wall 106 may support the base 102 in an upright manner where the sidewall 108 extends vertically and defines an upwardly facing opening 116. The opening is defined by a perimeter rim or edge 112 of the side wall 108 where the rim is engaged by the lid assembly 104 to close the container as will be described. The base 102 may be formed of plastic by molding or other similar process. Moreover the base may be made of glass, metal or other material if desired. While an embodiment of the container is shown the container may have a wide variety of shapes and sizes and the opening need not be upwardly opening. In the embodiment of FIGS. 9 through 16 the side wall 108 and base 102 define a substantially rectangular shape. The shape of the perimeter edge 112 of the base 102 conforms substantially to the shape of the cover portion 136 as defined by edge 136*a* as best shown in FIGS. 9 and 10.

Figure 11:
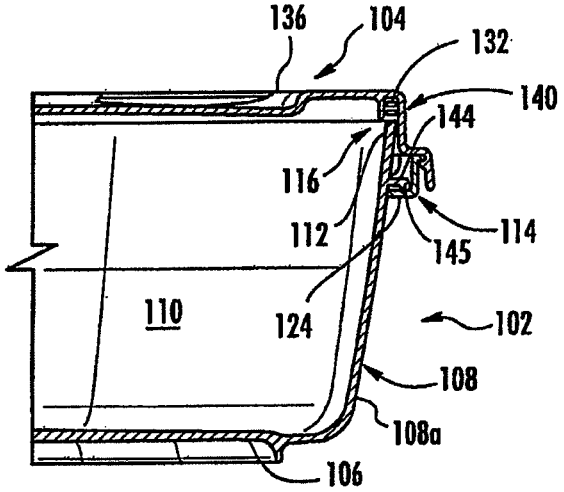
FIG. 11 is a section view taken along line 11-11 of FIG. 9.
Figure 12:
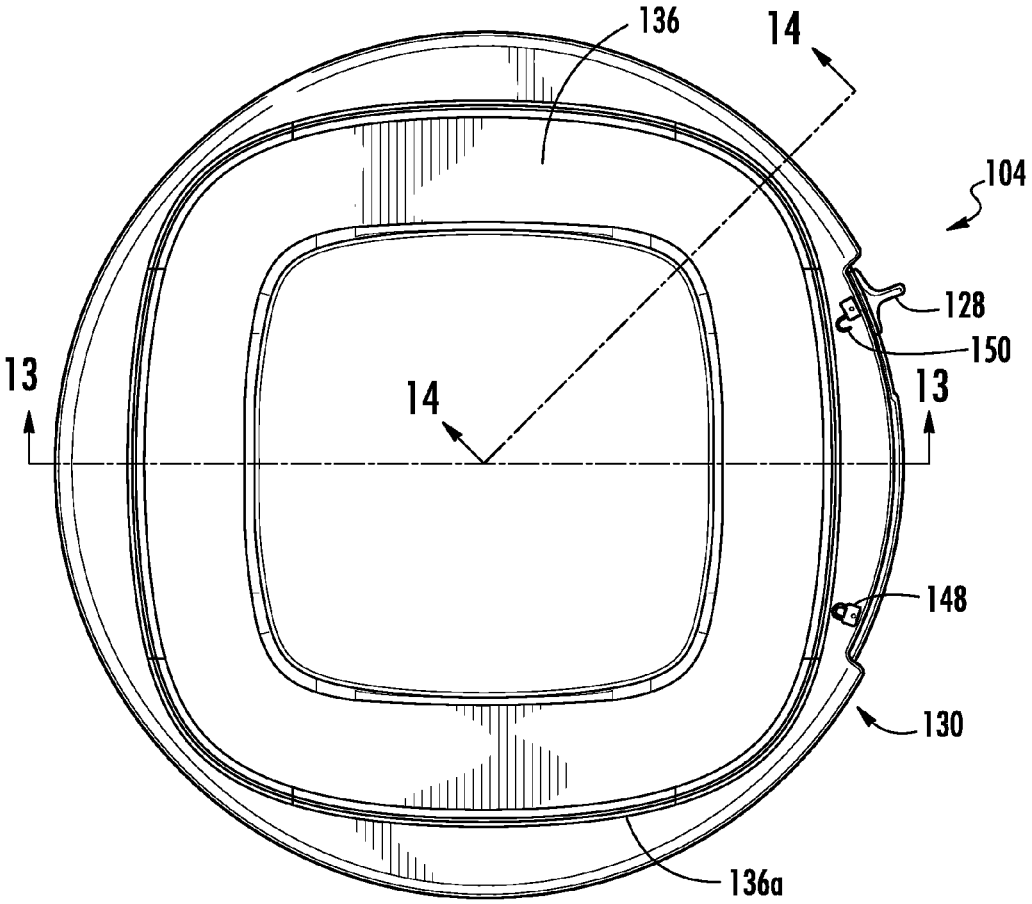
FIG. 12 is a top view of the container of FIG. 9 in an unlocked position.

A flange 144 extends from the side wall 108 of base 102 and may be located near the top edge 112 of the base. The flange 144 may be formed with a downwardly extending lip 145. The flange is has a circular shape with a diameter that is slightly smaller than the diameter of the lid assembly 104. Because the flange 144 has a circular shape and the side wall 108 has a rectangular shape, the distance the flange 144 projects from the side wall 108 varies as the circumference of the base 102 is traversed. Comparing FIGS. 10 and 11, the flange 144 extends the shortest distance from the side wall 108 at the corners 108*a* of the base (FIG. 11) and extends the greatest distance from the side wall 108 at a midpoint 108*b* between two corners of the base (FIG. 10) with the distance gradually increasing between a corner and a midpoint between two corners. Further, because the diameter of the lid assembly 104 is selected so as to be only slightly greater than the diagonal dimension of the base 102, the perimeter of the lid assembly more closely approaches the corners 108*a* of the base 102 than the mid-points 108*b*. As a result, the portions of flange 144 at the corners 108*a* of the base 102 form the stationary locking members as shown in FIG. 11, as will hereinafter be described.

A lid assembly 104 may comprise a lid 130, a separate seal or gasket 132 and a lock ring 114. The lid 130 comprises a cover portion 136 that defines a generally planar member that is shaped and dimensioned to fit over and close the opening 116 defined by the rim 112 of base 102. A seal ring or gasket 132 may be secured to the underside of the base cover portion 136. In one embodiment, the seal or gasket 132 may be a separate component that is attached to the lid 130 after manufacture as shown in FIG. 10. In the illustrated embodiment, the gasket or seal 132 is fit into a receptacle 138 formed on the underside of the lid 130 such that the gasket or seal 132 is disposed over the rim 112 of the base 102 when the lid assembly 104 is positioned on the base 102. The gasket or seal 132 may be secured to the lid 130 by a friction fit, fasteners, adhesive or the like. Alternatively, the lid 130 and the gasket or seal 132 may be formed as one-piece as shown at 32*a* in FIG. 17. For example, the gasket or seal 132 may be overmolded into the lid 130. Moreover, the lid 130 may not have a separately identifiable gasket or seal 132 such that the rim 112 of the base 102 makes contact with the lid 130.

The lid 130 also comprises an annular wall 140 that extends from the periphery of cover portion 136 and is dimensioned to extend over the side wall 108 of the base 102 a sufficient distance that the flange 144 is positioned inside of the wall 140 when the lid 130 is positioned on the base 102. The wall 140 defines a channel 129 that is dimensioned to receive a protrusion 134 on the lock ring 114 such that the lock ring 114 is secured to, but may rotate relative to, the lid 130. In one embodiment, the lock ring 114 comprises a central opening 118 that surrounds the base 102. Where the lid 130 and/or the lock ring 114 are made of deformable material such as molded plastic the protrusion 134 may be inserted into the channel 129 such that the lock ring 114 is constrained in channel 129. The material of the lid and/or the lock ring may deform to allow the protrusion 134 to enter channel 129. The lock ring 114 may be mounted to the lid 130 for rotational motion using other mechanisms than the protrusion and channel shown in the illustrated embodiment provided that the lock ring is free to rotate relative to the lid but is otherwise fixed to the lid. Moreover, additional elements may be used to mount the lock ring to the base; however, using a portion of the lid to restrain the lock ring may be the most economical embodiment.

Figure 15:
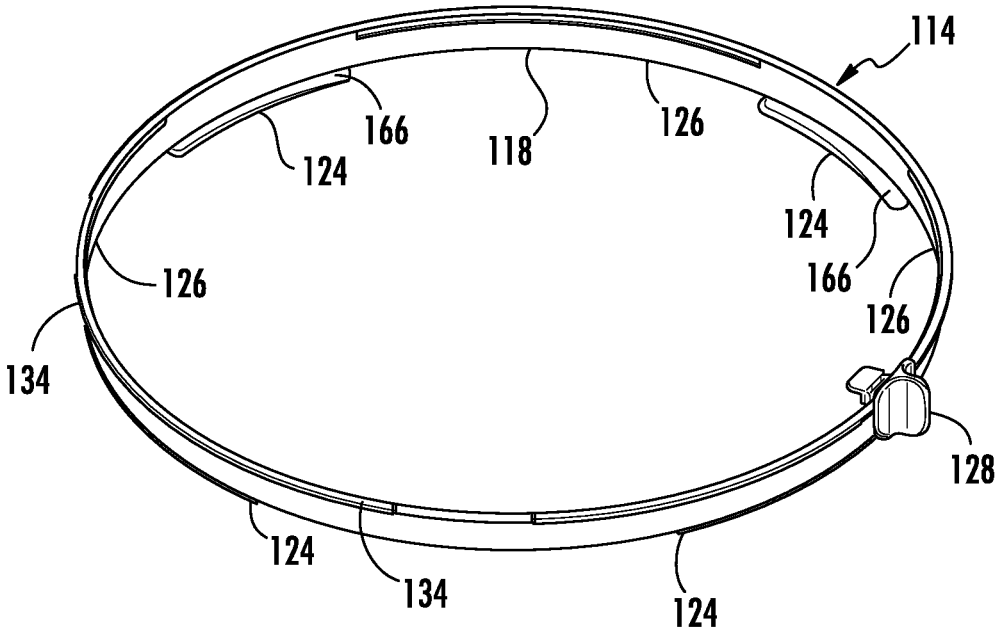
FIG. 15 is a perspective view of the lock ring of the container of FIG. 9.
Figure 16:
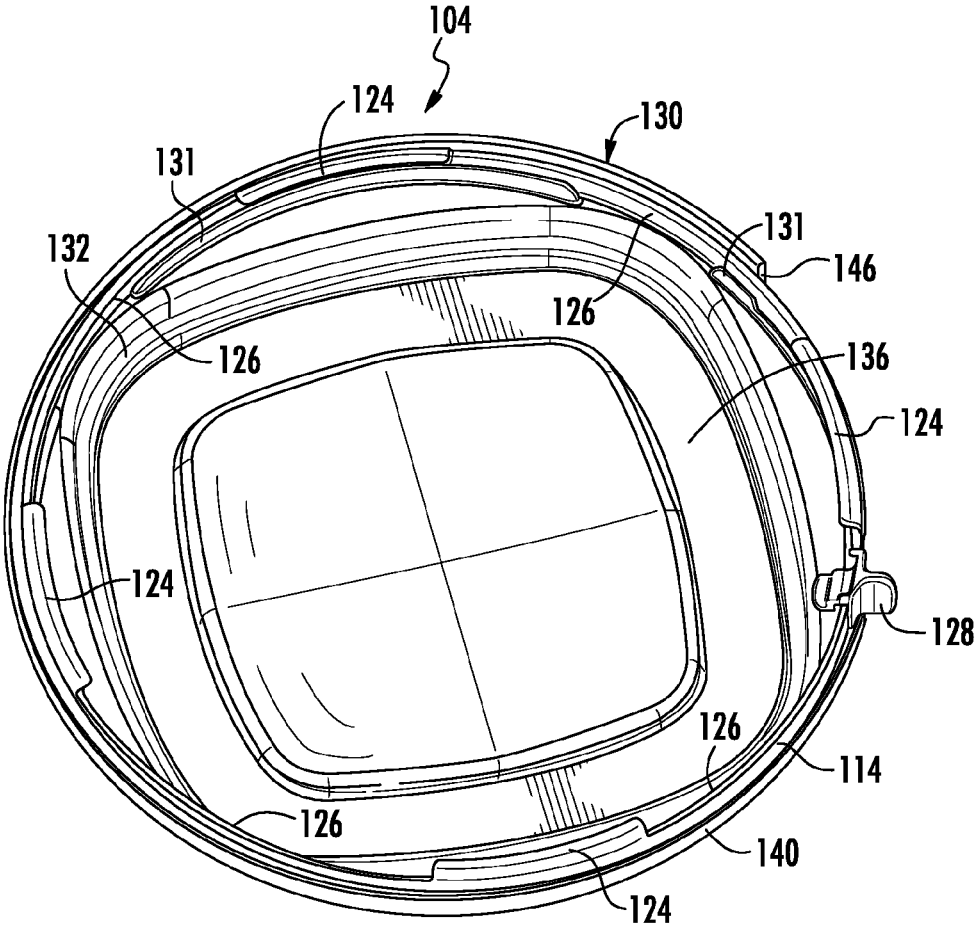
FIG. 16 is a bottom perspective view of the lid assembly of the container of FIG. 9.

Referring to FIGS. 15 and 16, the lock ring 114 has a peripheral edge that comprises a plurality of lock members 124 that extend from the ring 114 and are defined by protrusions that extend toward the center of the lock ring to form the lock members. Between the lock members 124 are recessed areas 126. In the illustrated embodiment, four protrusions that form four lock members 124 and four recessed areas 126 are equally spaced about the periphery of the lock ring 114. A greater or fewer number of lock members 124 may be used and the protrusions may be arranged in patterns other than the symmetrical pattern shown in the figures. A handle 128 projects from the ring 114 such that it extends beyond the outer periphery of the ring.

The lock ring 114 is positioned such that when the lid assembly 104 is positioned on the base 102 the lock ring is located outside of the flange 144. The wall 140 is formed with a gap 146 that receives the handle 128 on the lock ring 114. One end of the gap 146 is provided with a reference point such as a visual indication or indicia 148 indicating that the lid assembly 104 is locked to the base 102 and the opposite end of the gap 146 is formed with a reference point such as a visual indication or indicia 150 indicating that the lid is unlocked from the base. While the illustrated embodiment uses a gap 146 in the wall 140 for receiving the handle 128, the handle may be arranged such that is extends below the wall 140 or through a slot formed in the wall in which case the indicia may be provided on the lid assembly without the gap. The indicia 148 and 150 are located on the lid 130 such that when the handle 128 of the lock ring 114 is positioned in an aligned position with the unlocked indicia 150 the lid 130 may be placed on and removed from the base 102 and when the handle 128 of the lock ring is positioned in an aligned position with the locked indicia 148 the stationary lock members 144 on the base 102 interfere with the lock members 124 on the lock ring 114 such that the lid 130 cannot be removed from the base, and the lid may not be placed on the base. While the handle 128 is used as the reference point on the lock ring 114 to align the lock ring with the lid, the reference point on the lock ring may be a structure other than the handle. For example, the lock ring may be provide with a visual reference point such as a legend or indicia printed on the lock ring or a separate reference point such as a physical arrow or pointer may be provided.

Figure 13:
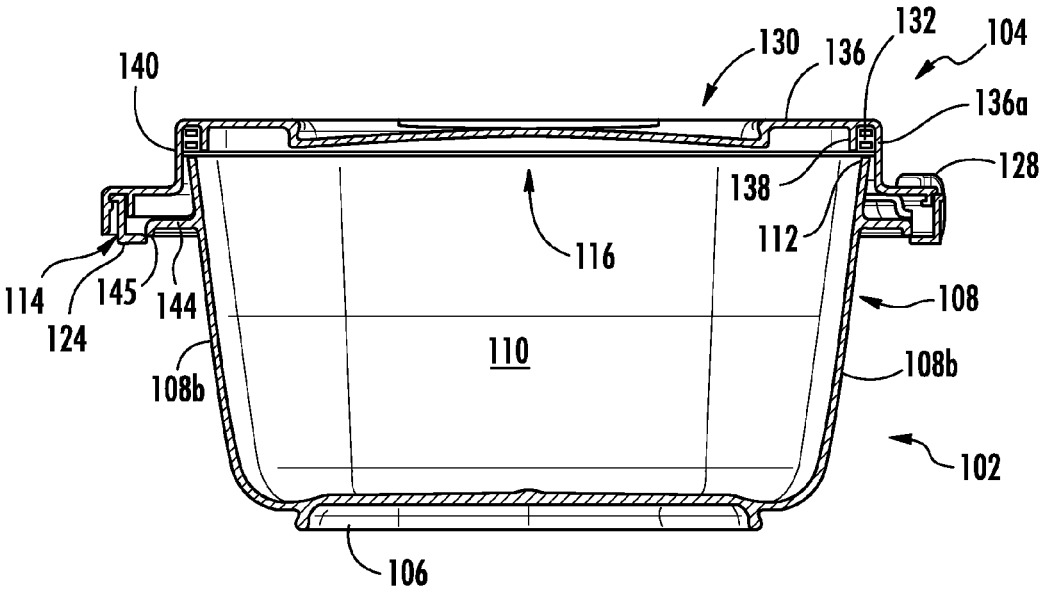
FIG. 13 is a section view taken along line 13-13 of FIG. 12.
Figure 14:
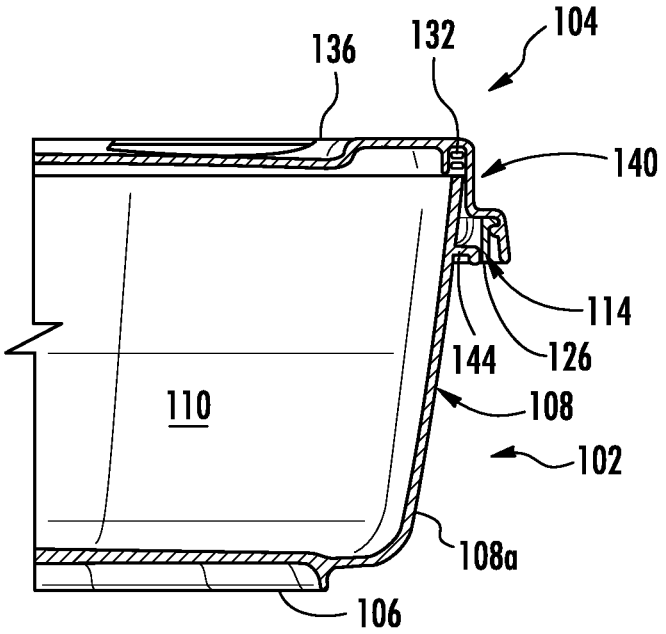
FIG. 14 is a section view taken along line 14-14 of FIG. 12.

To use the container of the invention, the lid assembly 104 is placed on the rim 112 of the base 102 such that the unlocked reference point 150 on the lid 130 is aligned with the reference point on the lock ring 114. In the illustrated embodiment the handle 128 is the reference point on the ring 114 that is aligned with the unlocked indicia 150 on the lid. In this aligned position the lock members 124 on the lock ring 14 are aligned with the midpoints **108*b* of the base 104, between the corners 108*a* of the base, where the periphery of the lid assembly 104 and the lock ring 112 are disposed farthest away from the flange 144. As a result, the lock members 124 do not interfere with the flange 144 as shown in FIG. 13 and the lid 130 may be seated on the rim 112 of the base 102 with the gasket 132 in sealing contact with the rim 112. The lock ring 114 is then rotated relative to the lid 130 until the handle 128 is in the locked position aligned with the locked indicia 148. In this position the lock members 124 on the lock ring 114 are rotated to the corners 108*a* of the base 102 where the periphery of the cover assembly 104 and the lock ring 114 are positioned closest to the flange 144. In this position the lock members 124 are positioned under or behind the flange 144 such that the lock members 124 engage or interfere with one another and the lid assembly 104 may not be removed from the base 102. To remove the lid 130 from the base, the handle is rotated to the unlocked position to disengage the lock members 124 from the stationary lock members formed by flange 144 at the corners 108*a***.

One of the lock ring 114 and the stationary lock ring 141 may be provided with a protrusion or protrusions 60 that engage with a recess or recesses 62 formed on the other of the lock ring 114 and the stationary lock ring 141 when the lock ring 114 is in the locked position to create a mechanical engagement between the lock ring 114 and the stationary lock ring 141 as previously described with reference to FIG. 6. The protrusion 60 and the recess 62 may be configured to create feedback to the user that the lock is engaged. For example the engagement of the protrusion 160 and recess 162 may provide tactile feedback and/or may create an audible noise when protrusion 160 snaps into the recess 162.

The engagement of the lock ring 114 with the stationary lock members creates a tight seal between the lid assembly 104 and the base 102. In one embodiment the user may exert pressure on the lid to slightly compress and deform the gasket or seal 132 prior to locking the lock ring 114. The lock member 144 and 124 are dimensioned such that after the lock ring 114 is locked and the user releases the lid 130 the gasket or seal 132 remains compressed between the lid 130 and the base 102 to create a liquid and air tight seal. One or both of the mating lock members may also be formed with angled camming surfaces 166 such that as the lock ring 114 is rotated the camming surfaces cooperate with the mating lock member to exert a force on the lid 130 that pulls the lid 130 into tight engagement with the gasket or seal 132 and base 102 such that the gasket or seal 132.

The lid and container of the invention may be locked and unlocked with a single motion of the end user moving the lock ring to the locked and unlocked positions. The lock ring does not require hand strength or dexterity and may be rotated by any part of the hand or arm such that the lock may be used by people with limited use of their hands.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A storage container comprising:

a base having a rim and an opening defined by the rim;

a lid configured to contact the rim to close the opening, the lid comprising a cover portion dimensioned to cover the opening and a wall that extends from the cover portion;

a lock ring movably mounted on the base for rotational motion about a periphery of the base between a first position and a second position, at least one lock member comprising a first protrusion extending outwardly from the lock ring, the lock ring being positioned entirely inside of the wall when the lid contacts the rim of the base to close the opening;

at least one stationary lock member on the lid comprising a second protrusion that extends inwardly from the wall;

the at least one lock member being positioned on the lock ring such that the at least one lock member is positioned behind the at least one stationary lock member when the lock ring is in the first position such that the first protrusion engages the second protrusion to lock the lid to the base, and the at least one lock member being laterally spaced from the at least one stationary lock member when the lock ring is in the second position such that the first protrusion does not engage the second protrusion, thereby permitting removal of the lid from the base, wherein the lock ring comprises a peripheral edge, the peripheral edge disposed below and inwardly of the rim when the lock ring is movably mounted on the base and the lid contacts the rim to close the opening.

2. The storage container of claim 1 wherein the lock ring is mounted on the base adjacent the opening.

3. The storage container of claim 2 further comprising a protuberance formed on the base and spaced from the rim where the lock ring is constrained for rotational motion between the protuberance and the rim.

4. The storage container of claim 1 wherein the peripheral edge of the lock ring comprises a plurality of lock members formed as a plurality of protrusions that alternate with a plurality of recessed areas.

5. The storage container of claim 4 wherein the at least one stationary lock member comprises a plurality of stationary lock members formed as a plurality of protrusions that are positioned to align with the plurality of recessed areas when the lock ring is in the second position.

6. The storage container of claim 5 wherein the plurality of stationary lock members extend from the wall such that the plurality of lock members are disposed behind the plurality of stationary lock members when the lock ring is in the first position.

7. The storage container of claim 1 further comprising a handle on the lock ring that extends from the lock ring.

8. The storage container of claim 1 wherein the lid comprises a seal configured such that the seal engages the rim when the lid is positioned on the base.

9. The storage container of claim 1 wherein a first indicia is formed on the lid to identify the first position and a second indicia is formed on the lid to identify the second position.

10. The storage container of claim 1 wherein at least one of the at least one lock member and the at least one stationary lock member is formed with a camming surface that engages the other one of the at least one lock member and the at least one stationary lock member to exert a force on the lid that pulls the lid into tight engagement with the base when the lock ring is rotated between the first position and the second position.

11. A storage container comprising:

a base having an opening;

a lid dimensioned to cover the base;

a lock ring movably mounted on the lid for rotational motion about a periphery of the lid between a first position and a second position, the lock ring comprising a protrusion that extends inwardly from a portion of the lid, a vertical wall portion that extends downwardly from the protrusion, and at least one lock member extending inwardly from the vertical wall portion;

at least one stationary lock member on the base;

wherein the at least one lock member is positioned on the lock ring such that the at least one lock member is aligned with the at least one stationary lock member when the lock ring is in the first position such that the at least one lock member engages the at least one stationary lock member to lock the lid to the base, and the at least one lock member being laterally spaced from the at least one stationary lock member when the lock ring is in the second position such that the at least one lock member does not engage the at least one stationary lock member, thereby permitting removal of the lid from the base.

12. The storage container of claim 11 wherein the lock ring comprises a peripheral edge that comprises a plurality of lock members formed as a plurality of protrusions that alternate with a plurality of recessed areas.

13. The storage container of claim 12 wherein the at least one stationary lock member comprises a flange that extends from the base.

14. The storage container of claim 13 wherein the at least one stationary lock member comprises a portion of the flange that is located at at least a corner of the base.

15. The storage container of claim 13 further comprising a plurality of stationary lock members formed on the base, the plurality of stationary lock members comprising a plurality of portions of the flange located at a plurality of corners of the base such that the plurality of lock members are disposed behind the plurality of stationary lock members when the lock ring is in the first position.

16. A storage container comprising:

a base having an opening;

a lid dimensioned to cover the opening;

a lock ring mounted on the base and being constrained for rotational motion about a periphery of the base between a first position and a second position, wherein the lock ring comprises a peripheral edge that comprises a plurality of lock members formed as a plurality of protrusions that alternate with a plurality of recessed areas;

a plurality of stationary lock members formed as a plurality of protrusions that are positioned to align with the plurality of recessed areas when the lock ring is in the second position;

wherein the lid comprises a wall that extends entirely over the lock ring when the lid is positioned on the base, the plurality of stationary lock members extending inwardly from the wall such that the plurality of lock members are disposed behind the plurality of stationary lock members when the lock ring is in the first position and the plurality of stationary lock members engages the plurality of lock members to lock the lid to the base, and the plurality of lock members being laterally spaced from the plurality of stationary lock members when the lock ring is in the second position such that the plurality of lock members do not engage the plurality of stationary lock members such that the lid is removable from the base.

17. A storage container comprising:

a base having an opening;

a lid dimensioned to cover the opening;

a lock ring mounted on the lid and being constrained for rotational motion about a periphery of the lid between a first position and a second position, wherein the lock ring comprises a protrusion that extends inwardly from a portion of the lid, a vertical wall portion that extends downwardly from the protrusion, and a peripheral edge that extends inwardly from the vertical wall portion and comprises a plurality of lock members formed as a plurality of protrusions that alternate with a plurality of recessed areas;

a plurality of stationary lock members formed on the base, the plurality of stationary lock members comprising a plurality of portions of a flange that extends from the base, the plurality of portions of the flange located at a plurality of corners of the base such that the plurality of lock members are disposed behind the plurality of stationary lock members when the lock ring is in the first position;

the plurality of lock members being positioned on the lock ring such that the plurality of lock members are aligned with the plurality of stationary lock members when the lock ring is in the first position such that the plurality of lock members engage the plurality of stationary lock members to lock the lid to the base, and the plurality of lock members being laterally spaced from the plurality of stationary lock members when the lock ring is in the second position such that the plurality of lock members do not engage the plurality of stationary lock members such that the lid is removable from the base.

18. The storage container of claim 17 wherein the lid comprises a wall that extends over the flange and supports the lock ring.

* * * * *